US009505506B2

(12) United States Patent
Ammann

(10) Patent No.: US 9,505,506 B2
(45) Date of Patent: Nov. 29, 2016

(54) DEVICE FOR SIMULTANEOUSLY FILLING AT LEAST TWO FOODS OF DIFFERENT COMPOSITIONS INTO ONE CONTAINER

(71) Applicant: Robert Bosch GmbH, Stuttgart (DE)
(72) Inventor: Rainer Ammann, Bobingen (DE)
(73) Assignee: Robert Bosch GmbH, Stuttgart (DE)

( * ) Notice: Subject to any disclaimer, the term of this patent is extended or adjusted under 35 U.S.C. 154(b) by 16 days.
(21) Appl. No.: 14/361,027
(22) PCT Filed: Nov. 23, 2012
(86) PCT No.: PCT/EP2012/073491
§ 371 (c)(1),
(2) Date: May 28, 2014
(87) PCT Pub. No.: WO2013/079411
PCT Pub. Date: Jun. 6, 2013
(65) Prior Publication Data
US 2014/0326360 A1 Nov. 6, 2014
(30) Foreign Application Priority Data
Nov. 28, 2011 (DE) ..... 10 2011 119 455
(51) Int. Cl.
*B65B 3/36* (2006.01)
*B65B 43/59* (2006.01)
*B65B 39/00* (2006.01)
(52) U.S. Cl.
CPC ..... *B65B 3/36* (2013.01); *B65B 43/59* (2013.01); *B65B 2039/009* (2013.01); *B65B 2220/14* (2013.01)
(58) Field of Classification Search
CPC ..... B65B 39/00; B65B 39/003; B65B 2039/009; B65B 39/001; B65B 43/59; B65B 2220/14; B65B 3/36; A23G 9/282
USPC ..... 141/100–105, 234, 236
See application file for complete search history.

(56) References Cited

U.S. PATENT DOCUMENTS 2,389,084 A * 11/1945 Routh ..... A23G 9/282 366/169.2
3,439,841 A * 4/1969 Rhodes ..... 222/142.5
(Continued)

FOREIGN PATENT DOCUMENTS

DE 29512257 10/1995
DE 10140001 3/2003
(Continued)

OTHER PUBLICATIONS

International Search Report for Application No. PCT/EP2012/073491 dated Apr. 10, 2013 (English Translation, 2 pages).

*Primary Examiner* — Mark A Laurenzi
*Assistant Examiner* — Andrew StClair
(74) *Attorney, Agent, or Firm* — Michael Best & Friedrich LLP

(57) ABSTRACT

A device for simultaneously filling at least two foods of different compositions, predominantly in a thick fluid and/or pasty form, into a container, particularly a transparent plastic cup, having a valve head with a nozzle inlet opening and nozzle outlet openings for the food and fed by dosing devices, wherein the controller has a control disc (23) rotatable about a longitudinal axis (22) in the valve head (1) having control openings (25*a*, 25*b*, 25*c*) distributed about said longitudinal axis (22) on a first control circuit path (24), said control openings being alignable during an incremental rotation of the control disc (23) alternating in succession with auxiliary nozzle inlet openings (26*a*, 26*b*, 26*c*) of a stationary control surface (27) of the valve head (1) lying below in a planar manner, wherein auxiliary nozzle inlet openings (26*a*, 26*b*, 26*c*) are arranged on a second control circuit path (24') congruent with the first control circuit path about the longitudinal axis (22) in the control surface (27) such that helically rising individual portions (28) of the second food (8) from corresponding auxiliary nozzle outlet openings (30) can be positioned on the inner wall of the cup (29) during the filling process. A main nozzle (31) is provided below the control surface (27) in the valve body within the control circuit paths and auxiliary nozzle inlet openings on the longitudinal axis arranged along the same paths; the feed of said nozzle with the food forming the main component is controlled in the known manner by only one rotary disc valve (13) in the supply line (15) coming from the corresponding dosing device (3).

8 Claims, 5 Drawing Sheets

(56) References Cited

U.S. PATENT DOCUMENTS

| | | | | | |
|---|---|---|---|---|---|
| 4,397,407 | A * | 8/1983 | Skoupi | B29B 7/7631 | 222/132 |
| 5,019,127 | A * | 5/1991 | Bohm et al. | 222/1 | |
| 5,309,955 | A * | 5/1994 | Torterotot | 141/1 | |
| 5,344,052 | A * | 9/1994 | Divall et al. | 222/135 | |
| 5,415,534 | A * | 5/1995 | Bertrand et al. | 425/104 | |
| 5,529,099 | A * | 6/1996 | Janek et al. | 141/129 | |
| 5,996,652 | A * | 12/1999 | Schromm | 141/172 | |
| 7,559,346 | B2 * | 7/2009 | Herrick et al. | 141/105 | |

FOREIGN PATENT DOCUMENTS

| | | | | |
|---|---|---|---|---|
| DE | 60214970 | | 9/2007 | |
| EP | 1657159 | | 5/2006 | |
| EP | 1657159 | A1 * | 5/2006 | B65B 3/32 |
| EP | 1842773 | | 10/2007 | |
| EP | 1980153 | * | 10/2008 | |
| FR | 2708563 | * | 8/1993 | |
| FR | 2868399 | * | 10/2005 | |
| WO | WO 02/053456 | * | 7/2002 | |

* cited by examiner

DEVICE FOR SIMULTANEOUSLY FILLING AT LEAST TWO FOODS OF DIFFERENT COMPOSITIONS INTO ONE CONTAINER

BACKGROUND OF THE INVENTION

The invention relates to a device for simultaneously filling at least two foods of different compositions, in a free-flowing and/or highly viscous form, into transparent cups of plastics material or glass, by way of a valve head, which comprises nozzle lines with outlet openings for the foods, is supplied by dosing devices and, with a relative movement between the cup and the valve head, fills the cup from the bottom thereof with a first of the foods as the main component part of the filling and with a second of the foods as the additional component part of the filling distributed in the cup in the form of individual portions, wherein, during the filling operation, a control means carries out a distributing of the different foods in the respective cup according to the height level, radial level and quantity of the same by means of alternately opening and closing the nozzle lines.

The foods are first and foremost such produced from yoghurt or they are puddings, it being possible to use such foods in each case with different colorings and/or flavors. For example, vanilla pudding can be the main filling component part, to which, distributed in individual portions in the cup, chocolate pudding is to be added as the additional filling component part.

EP 1 842 773 A2 makes known a device of said design where the cups remain stationary underneath the valve head, whilst the respective valve head is moved into the respective cup during the filling operation and out of the same again during the filling. In addition, each valve head is also laterally movable in such a manner that as a result of a computer-controlled movement of the valve head in the case of, for example, differently colored foods, also as a result of computer-controller intermittent opening and closing of the respective nozzles of the valve head, portions of the food can be delivered over the height and the circumference of the respective cup. As the cups have transparent walls, the patterns created in each case are visible and can present interested customers with a particularly attractive sight making them want to buy.

However, the known design is particularly expensive as a result of the necessary kinematics for the respective valve heads which really have to be movable in a controlled manner both vertically and at the same time sideways.

SUMMARY OF THE INVENTION

The object underlying the invention is, therefore, to create a device of the design named in the introduction which is realized structurally in a considerably simpler manner and is producible with a smaller amount of expenditure, it also being possible to maintain the conventional kinematics as a result of initially lifting the cup and subsequently filling the same when lowering the cup.

Said object is achieved according to the invention in that the control means comprises a control disk, which is rotatable about a longitudinal axis in the valve head, with control openings which are distributed about said longitudinal axis along a first control circuit and which, when the control disk is rotated in rotational steps out of a first closed position, prior to achieving a second closed position, are movable one after another in an alternating manner into coincidence with auxiliary nozzle inlet openings in a stationary control face of the valve head which lies underneath in a planar manner, which auxiliary nozzle inlet openings are arranged along a second control circuit which is congruent with the first control circuit in the control surface about the longitudinal axis in such a manner that during the filling operation, in a helically increasing manner, individual portions of the second food which forms the additional component part are positionable on the inside wall of the cup by corresponding auxiliary nozzle outlet openings, and that a main nozzle, the feeding of which with the first food which forms the main component part is controlled in a known manner by only one rotary slide in the supply line which comes from the associated dosing device, is provided below the control surface in the valve head inside the second control circuits and the auxiliary nozzle inlet openings distributed along the same along the longitudinal axis.

In an expedient manner, a control shaft, which is connected in a rigid manner to the control disk and is coaxial with respect to the longitudinal axis, is provided for the rotational stepping of said control disk.

In an advantageous manner, the auxiliary nozzle outlet openings are arranged in the valve head in such a manner that they remain close to the inside wall of the cup during filling when the cup is moved downward in order to be able to position the discrete portions better on the inside wall of the cup, which then results in one of the patterns mentioned above which are visible on the outside of the cup.

In the case of a preferred embodiment, three control openings (25*a*, 25*b*, 25*c*) which can lead to the auxiliary nozzle outlet openings by means of three auxiliary nozzle lines (30) are distributed along the control circuit. However, further control openings with further auxiliary nozzle lines can also be provided.

In this case, the procedure according to the invention is such that once the cup has been lifted close to the outlet nozzle end of the valve head, the main nozzle is opened at the start of the connecting downward movement of the cup, that at the same time or shortly thereafter, as a result of a first rotational step of the control disk, the first auxiliary nozzle inlet opening lying on the second control circuit is opened, that subsequently, as a result of a second rotational step of the control disk, the first nozzle inlet opening is closed again and the second inlet opening following on the second control circuit is opened, and that in the same way, as a result of a rotational step or further rotational steps, one auxiliary nozzle inlet opening or further auxiliary nozzle inlet openings located on the second control circuit are opened and closed again one after another until the filling of the cup is concluded as a result of closing the last auxiliary nozzle inlet opening and also the main nozzle.

In a preferred manner, in this case, the method is conducted in such a manner that from the first closed position of the control disk, after a first rotational step of the same of 25°, its first control opening is in alignment with a first auxiliary nozzle inlet opening and a first auxiliary nozzle line opens, that after a subsequent second rotational step of the same of 35°, the first auxiliary nozzle line is closed again and the second control opening of the control disk is in alignment with a second auxiliary nozzle inlet opening and a second auxiliary nozzle line opens, that after a subsequent third rotational step of the same of 35°, the second auxiliary nozzle line is also closed again and the third control opening of the control disk is in alignment with a third auxiliary nozzle inlet opening and a third auxiliary nozzle line opens, and that after a subsequent fourth rotational step of the same of 25°, the second closed position is reached and all the auxiliary nozzle lines are closed, whereby a first control cycle for distributing three portions of the additional component part in the main component part of the filling of a first cup is concluded.

In addition, it has also proved to be expedient in the case of a subsequent second control cycle for filling the next cup 16, the control disk 23 is returned from the second closed position by way of corresponding rotational steps into the first closed position, wherein the respective opening pairs 25*c*, 26*c*; 25*b*, 26*b* and 25*c*, 26*c* open and close in the reverse sequence.

Nonetheless, it is also possible to allow the control disk to jump back from its second closed position into its first closed position in order to repeat the first control cycle when filling the next cup.

BRIEF DESCRIPTION OF THE DRAWINGS

The invention and its advantageous developments are the object of the claims and are explained in more detail below by way of an exemplary embodiment which is shown in the drawings, in which:

DETAILED DESCRIPTION

Figure 1:
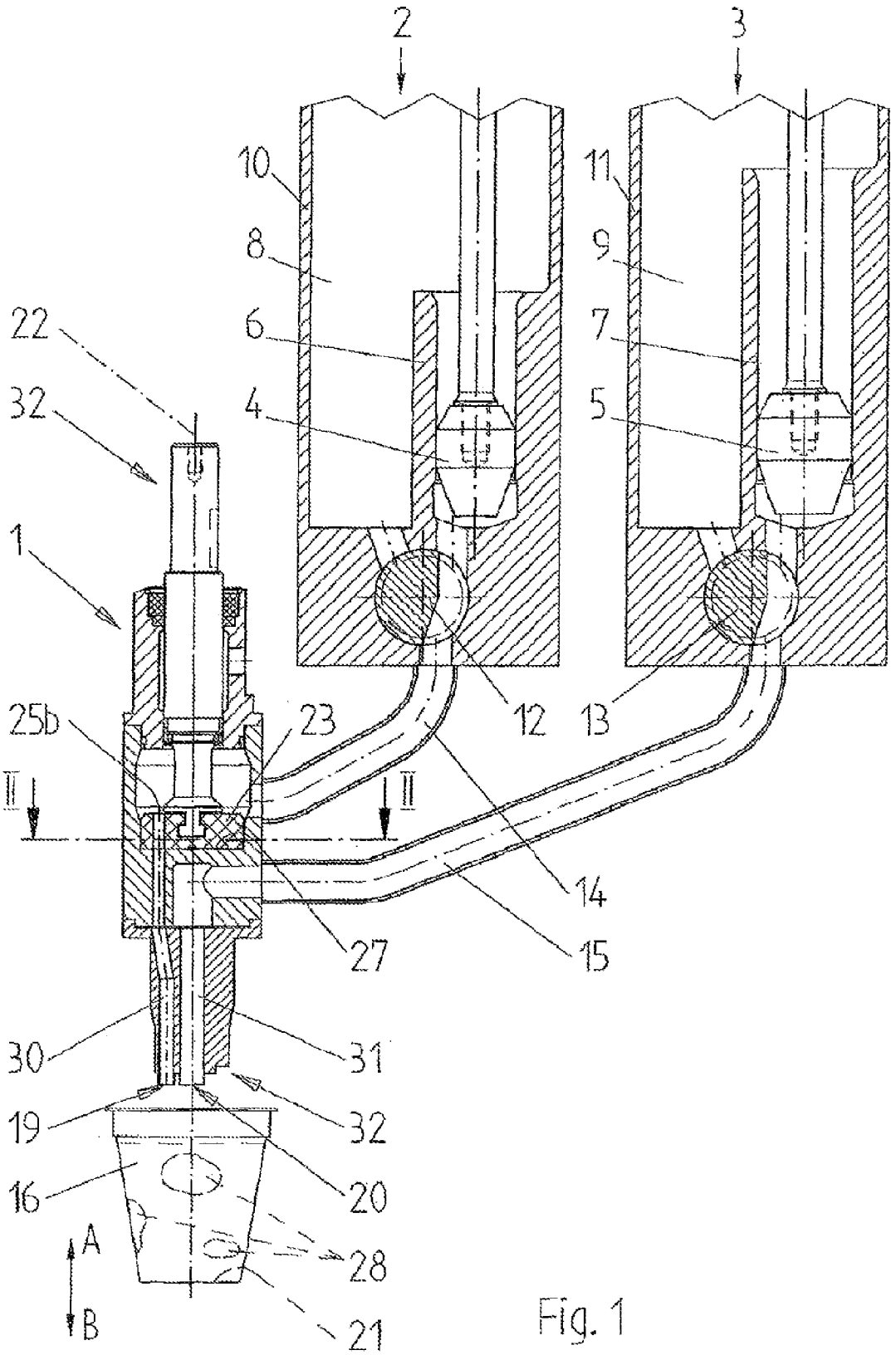
FIG. 1 shows a vertical longitudinal section through an embodiment of the invention with a valve head and two dosing piston cylinder units for two foods of different compositions.

FIG. 1 shows a device for simultaneously filling at least two foods 8 and 9 of different compositions, in a free-flowing and/or highly viscous form, into transparent cups 16 of plastics material or glass, by way of a valve head 1, which comprises nozzle lines 30, 31 with outlet openings 19, 20 for the foods, is supplied by dosing devices 1 and 2, and with a relative movement between the cup 16 and the valve head 1, fills the cup from the bottom 21 thereof with a first of the foods as the main component part 9 of the filling and with a second of the foods as the additional component part 8 of the filling distributed in the cup 16 in the form of individual portions 28, wherein, during the filling operation, a control means carries out a distributing of the different foods in the respective cup 16 according to the height level, radial level and quantity of the same by means of alternately opening and closing the nozzle lines.

An individual valve head 1 with two connected dosing piston cylinder units as dosing devices 2 and 3 can be seen, in particular, in FIG. 1. The two dosing pistons 4 and 5 are situated practically in their respective bottom end position inside their dosing cylinder 6 and 7, this means that the filling of the two different foods 8 and 9 out of storage hoppers 10 and 11 by means of rotary slides 12 and 13 and associated lines 14 and 15 into the cup 16 is practically completed. The empty cup 16 had first of all been lifted in the direction of the arrow A in a known manner as far as almost to touching the bottom end of the valve head 1, as a result of which the filling operation began, the cup 16 having been lowered again in the direction of the arrow B according to its increasing filling.

Figure 3:
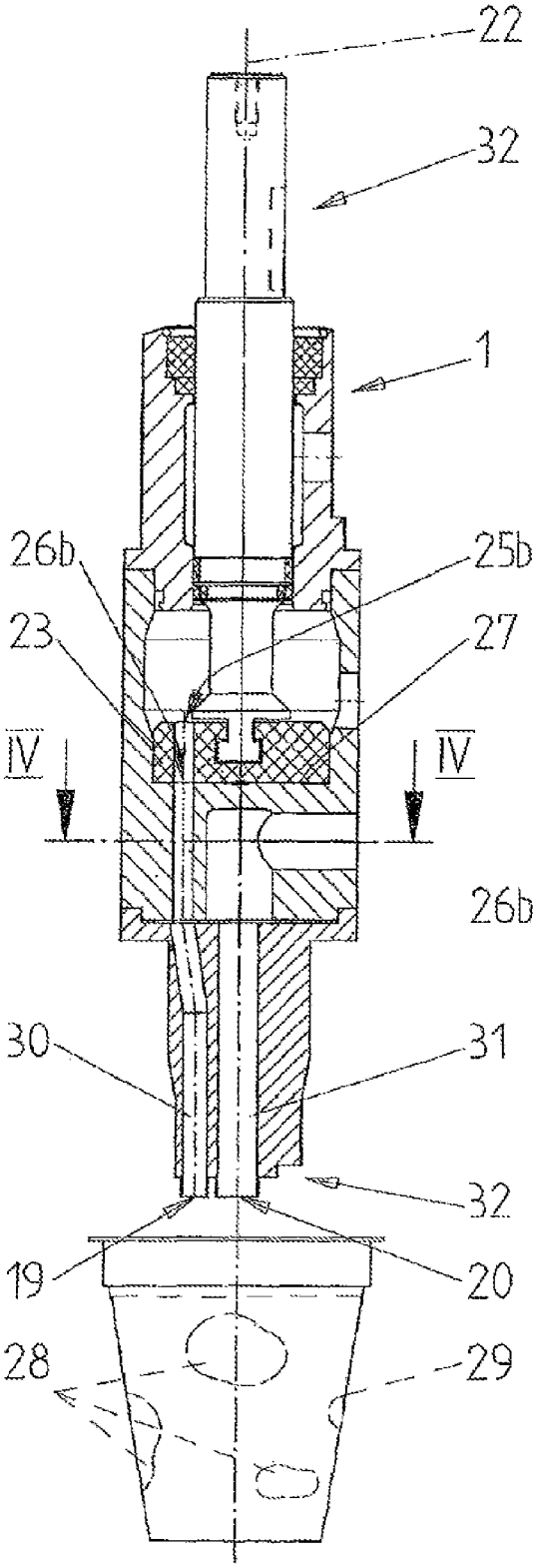
FIG. 3 shows an enlarged longitudinal section corresponding to FIG. 1 through the valve head.
Figure 4:
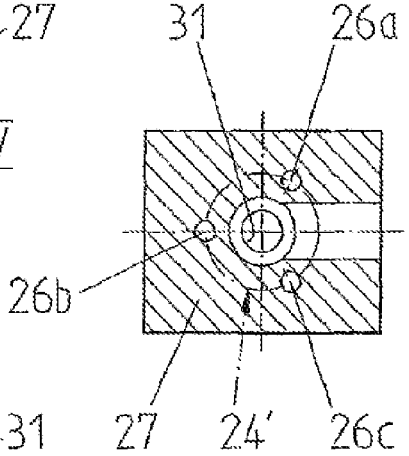
FIG. 4 shows a section along the line IV-IV in FIG. 3.

According to the invention, the control means is then a control disk 23, which is rotatable about a longitudinal axis 22 in the valve head 1, with control openings 25*a*, 25*b*, 25*c*, which are distributed about said central axis 22 along a first control circuit 24 (see FIG. 2) and which, when the control disk 23 is rotated in rotational steps from a first closed position (FIG. 2*a*), prior to reaching a second closed position (FIG. 2*e*), are movable one after another in an alternating manner into coincidence with auxiliary nozzle inlet openings 26*a*, 26*b*, 26*c* in a stationary control surface 27 which lies underneath in a planar manner, which auxiliary nozzle inlet openings 26*a*, 26*b*, 26*c* are arranged along a second control circuit 24' (FIG. 4), which is congruent with the first control circuit in the control surface 27 about the longitudinal axis 22 in such a manner that during the filling operation, in a helically increasing manner, individual portions 28 of the second food 8 are positionable on the inside wall 29 of the cup (see FIG. 3) by corresponding auxiliary nozzle outlet openings 19.

In addition, a main nozzle 31 (i.e. main nozzle line 31), the feeding of which with the first food 9 which forms the main component part is controlled in a known manner by only one rotary slide 13 in the supply line 15 which comes from the associated dosing device 2, is provided below the control surface 27 in the valve head 1 inside the second control circuit 24' and the auxiliary nozzle inlet openings 26*a*, 26*b*, 26*c* distributed along the same on the longitudinal axis 22.

A control shaft 32, which is connected in a rigid manner to the control disk 23 and is coaxial with respect to the longitudinal axis 22, is provided for the rotational stepping of said control disk.

The auxiliary nozzle outlet openings (only the opening 19 of which can be seen in FIGS. 1 and 3) are expediently arranged in the valve head 1 in such a manner that they remain close to the inside wall 29 of the cup during filling when the cup 16 is moved downward, in order to deposit the mentioned portions 28 of the second food 8 which forms the additional component part in a visible manner on the inside of the cup 16. The simultaneous filling with the first food 9 which forms the main component part by means of the nozzle 31 is effected centrally and continuously in a conventional manner.

In the case of the preferred exemplary embodiment shown, three control openings 25*a*, 25*b*, 25*c*, which lead to the associated auxiliary nozzle outlet openings by means of three auxiliary nozzle lines (only the auxiliary nozzle line 30 can be seen), are distributed along the first control circuit 24. According to FIGS. 2 and 4, three auxiliary nozzle inlet openings are accordingly present, even though only one of the associated auxiliary nozzle lines is visible in FIGS. 1 and 3, namely the named line 30.

The method for operating the device is expediently as follows:

once the cup 16 has been lifted close to the outlet nozzle end 32 of the valve head 1, the main nozzle 31 is opened at the start of the subsequent downward movement of the cup 16, at the same time or shortly thereafter, as a result of a first rotational step of the control disk (23), the first auxiliary nozzle inlet opening (26*a*) lying on the second control circuit (24') is opened, subsequently, as a result of a second rotational step of the control disk 23, the first nozzle inlet opening 26*a* is closed again and the second inlet opening (26*b*) is opened, and finally in the same way, as a result of a rotational step or further rotational steps, one auxiliary nozzle inlet opening or further auxiliary nozzle inlet openings located on the second control circuit 24' are opened and closed again one after another until the filling of the cup 16 is concluded as a result of closing the last auxiliary nozzle inlet opening and also the main nozzle 31.

In this case, the procedure is preferably in such a manner that from the first closed position (FIG. 2*a*) of the control disk 23, after a first rotational step of the same of 25°, its first control opening 25*a* is in alignment with a first auxiliary nozzle inlet opening 26*a* and a first auxiliary nozzle line opens (FIG. 2*b*), that after a subsequent second rotational step of the same of 35°, the first auxiliary nozzle line is closed again and the second control opening 25*b* of the control disk 23 is in alignment with a second auxiliary nozzle inlet opening 26*b* and a second auxiliary nozzle line (30) opens (FIG. 2*c*), that after a subsequent third rotational step of the same of 35°, the second auxiliary nozzle line is also closed again and the third control opening 25*c* of the control disk 23 is in alignment with a third auxiliary nozzle inlet opening 26*c* and a third auxiliary nozzle line opens (FIG. 2*d*), and that after a subsequent fourth rotational step of the same of 25°, the second closed position is achieved (FIG. 2*e*) and all the auxiliary nozzle lines, e.g. also the line 30, are closed, whereby a first control cycle for distributing three portions of the additional component part in the main component part of the filling of a first cup 16 is concluded.

In the case of a subsequent further control cycle for filling the next cup 16, it is preferred to return the control disk 23 from the second closed position by way of corresponding rotational steps into the first closed position, wherein the respective opening pairs open and close in the reverse sequence, namely 25*c*, 26*c*; 25*b*, 26*b* and 25*a*, 26*a*.

Figure 2A:
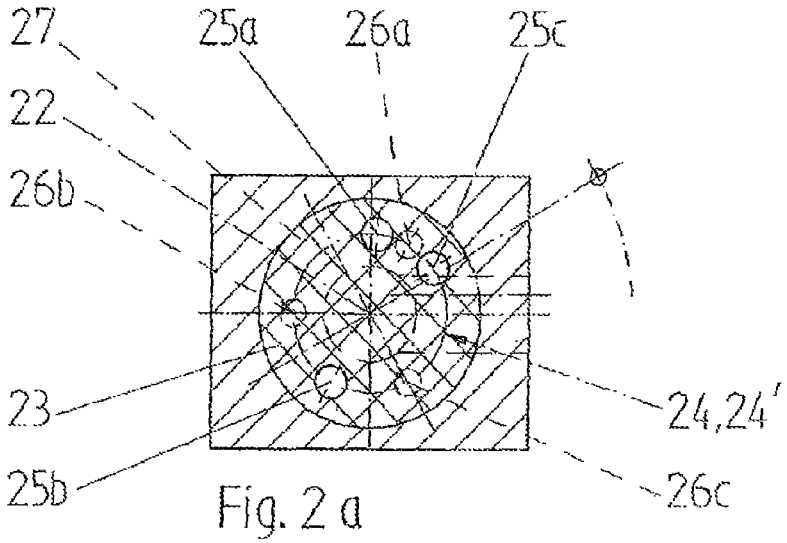
FIG. 2*a* to FIG. 2*e* show a cross section through the embodiment according to FIG. 1 along the line II-II in five individual images which show the possible open and closed positions of the control openings of the control disk in relation to the nozzle inlet openings of the control surface.
Figure 2B:
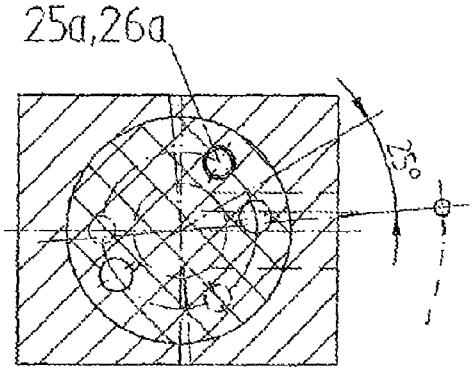
Figure 2C:
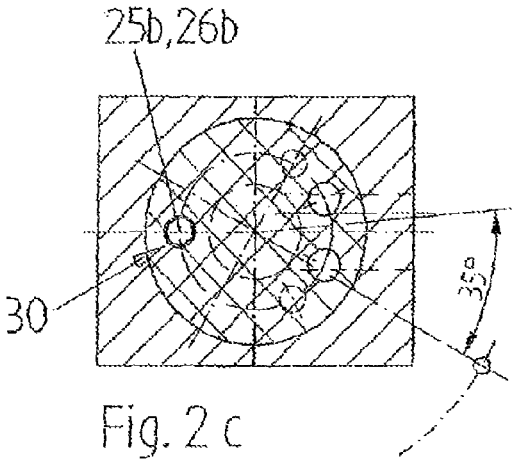
Figure 2D:
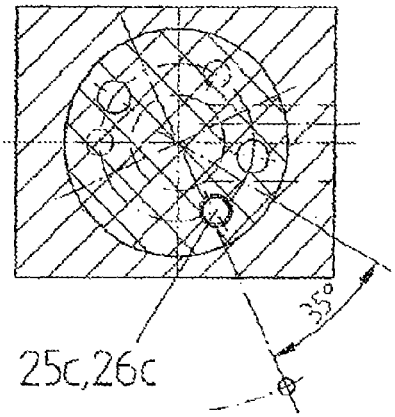
Figure 2E:
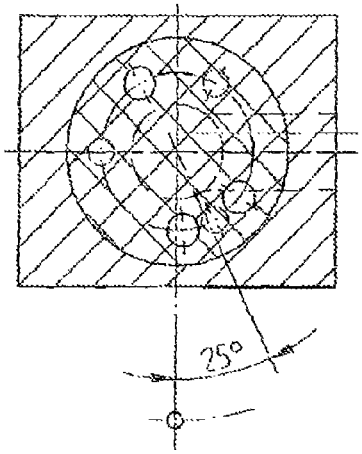

As already mentioned, it is also possible to allow the control disk 23 to jump back out of the second closed position according to FIG. 2*e* into the first closed position according to FIG. 2*a* before a further control cycle to fill a further cup 16 is effected.

Figure 5:
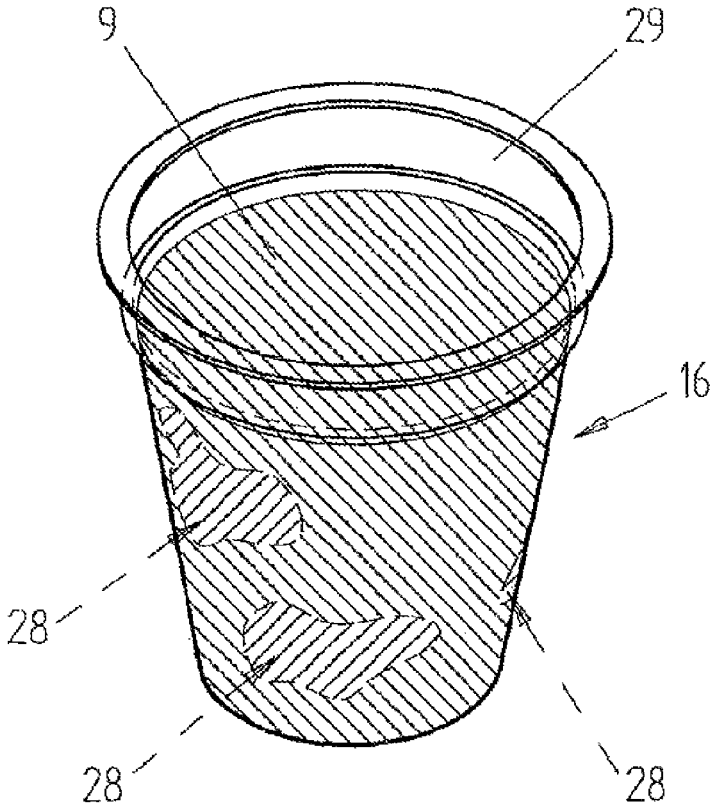
FIG. 5 shows a diagrammatic view of an example of a cup filled according to the invention prior to the closing of the same.
Figure 6:
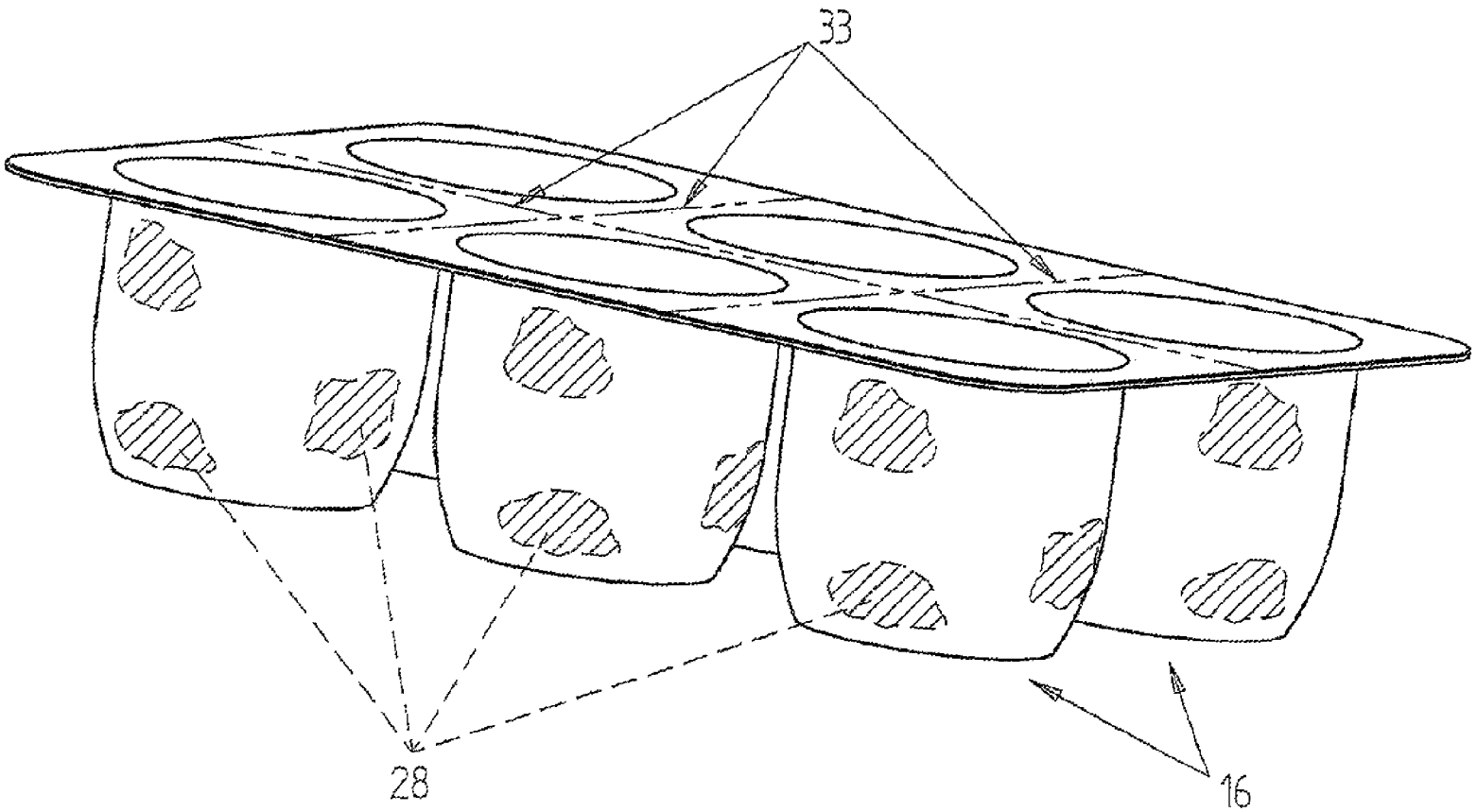
FIG. 6 shows a diagrammatic view of a six-pack produced from cups filled according to the invention.

It is obvious that in a known manner several of the devices according to the invention can be arranged side by side in a multiple-track filling installation in order to fill cups 16 supplied in several tracks. In this case, combination packs which are formed from several cups 16 connected together can also be filled, FIG. 6 shows an example of such a pack 32 which consists of six cups 16 which can be divided into individual filled cups 16 (FIG. 5) along tear lines 33.

As can be seen from FIGS. 2*a* to 2*e*, in the case of the preferred exemplary embodiment shown, the opening pairs are formed in the sequence 25*a*, 26*a*; 25*b*, 26*b*; 25*c*, 26*c*, or however in the reverse sequence 25*c*, 26*c*; 25*b*, 26*b*; 25*c*, 26*c*, however the opening pairs do not lie in the same sequence along the control circuits 24 or 24'. Rather, the third opening pair 25, 26*c* lies on the control circuits between the first opening pair 25*a*, 26*a* and the second opening pair 25*b*, 26*b*. This simplifies the necessary rotational steps of the control disk 23.

The invention claimed is:

1. A device for simultaneously filling at least a first food and a second food of different compositions into a cup, the device comprising:

a valve head (1) including a plurality of nozzle lines, each nozzle line having an outlet opening for dispensing one of the first food and the second food; and a control assembly including a control disk (23) rotatable about a longitudinal axis (22) in the valve head (1), the control disk defining control openings (25*a*, 25*b*, 25*c*) distributed about said longitudinal axis (22) along a first control circuit (24) and movable with rotation of the control disk (23) into and out of coincidence with auxiliary nozzle inlet openings (26*a*, 26*b*, 26*c*) in a stationary control surface (27) of the valve head (1), wherein the auxiliary nozzle inlet openings (26*a*, 26*b*, 26*b*) are arranged along a second control circuit (24') congruent with the first control circuit in the control surface (27) about the longitudinal axis (22) such that during a filling operation individual portions (28) of the second food are positionable on an inside wall (29) of the cup via one of the outlet openings, wherein the plurality of nozzle lines includes a main nozzle line for dispensing the first food, and the main nozzle line is only controllable by one rotary slide (13) in a supply line (15) coupled to an associated dosing device (3) and is disposed below the stationary control surface (27) in the valve head (1) inside the second control circuit (24') such that dispensing through the main nozzle line is independent of the control surface, wherein a control shaft rigidly connected to the control disk and coaxial with the longitudinal axis is configured for rotational stepping of the control disk, and wherein the supply line (15) connects the dosing device (3) to the valve head (1), and the supply line (15) is coupled to the valve head (1) downstream of the stationary control surface (27) such that the first food does not pass through the control disk (23).

2. The device as claimed in claim 1, wherein the control openings include three control openings, each of which leads to an associated outlet opening for dispensing the second food.

3. A method for operating the device as claimed in claim 1, the method including:

lifting the cup toward an outlet nozzle end (32) of the valve head (1);

once the cup (16) has been lifted, opening the main nozzle line at a start of subsequent downward movement of the cup (16);

at the same time or subsequently, rotating the control disk (23) such that a first auxiliary nozzle inlet opening of the auxiliary nozzle inlet openings of the second control circuit (24') is opened;

subsequently, rotating the control disk (23) such that the first auxiliary nozzle inlet opening is closed again and a second auxiliary nozzle inlet opening of the second control circuit (24') is opened; and rotating the control disk such that one auxiliary nozzle inlet opening or further auxiliary nozzle inlet openings of the auxiliary nozzle inlet openings located on the second control circuit (24') are opened and closed again one after another until the filling of the cup (16) is concluded.

4. The method as claimed in claim 3, further including from a first closed position of the control disk (23), rotating the control disk after a first rotational step of the same of 25° such that a first control opening of the control openings is in alignment with the first auxiliary nozzle inlet opening and a first auxiliary nozzle line of the plurality of nozzle lines opens;

subsequently rotating the control disk 35° such that the first nozzle line is closed again and a second control opening is in alignment with a second auxiliary nozzle inlet opening and a second nozzle line opens;

subsequently rotating the control disk 35° such that the second nozzle line is closed again and a third control opening is in alignment with a third auxiliary nozzle inlet opening and a third nozzle line opens; and subsequently rotating the control disk 25° such that a second closed position is reached and each of the plurality of nozzle lines is closed, whereby a first control cycle for distributing three portions of the second food is concluded.

5. The method as claimed in claim 4, further including returning the control disk (23) from the second closed position by way of corresponding rotational steps into the first closed position, wherein respective pairs of control openings and auxiliary nozzle inlet openings open and close in a reverse sequence.

6. The device as claimed in claim 4, wherein the third auxiliary nozzle inlet opening lies on the second control circuit between the first auxiliary nozzle inlet opening and the second auxiliary nozzle inlet opening.

7. The device of claim 1, wherein movement of the control disk is independent of the main nozzle line.

8. The device of claim 1, wherein the control disk is movable relative to the main nozzle line.

* * * * *